US005688564A

United States Patent [19]

Coddet et al.

[11] Patent Number: 5,688,564

[45] Date of Patent: Nov. 18, 1997

[54] PROCESS FOR THE PREPARATION AND COATING OF A SURFACE

[75] Inventors: Christian Louis Michel Coddet, Giromagny; Thierry Marchione, Osthouse, both of France

[73] Assignees: Institut Polytechnique de Sevenans, Belfort Cedex; Irepa Laser, Strasbourg, both of France

[21] Appl. No.: 520,127

[22] Filed: Aug. 28, 1995

Related U.S. Application Data

[63] Continuation-in-part of Ser. No. 93,715, Jul. 20, 1993, abandoned.

[30] Foreign Application Priority Data

Jul. 23, 1992 [FR] France ..... 92 09277

[51] Int. Cl.[6] ..... B05D 3/00

[52] U.S. Cl. ..... 427/554; 427/314; 427/327; 427/376.2; 427/376.3; 427/376.4; 427/376.6; 427/376.7; 427/376.8; 427/383.1; 427/422; 427/424; 427/427; 427/454; 427/456; 427/559; 427/596; 427/597

[58] Field of Search ..... 427/554, 559, 427/596, 597, 454, 456, 327, 314, 376.2, 376.3, 376.4, 376.6, 376.7, 376.8, 383.1, 422, 424, 427

[56] References Cited

U.S. PATENT DOCUMENTS 4,832,798 5/1989 Cvijanovich et al. ..... 427/555

*Primary Examiner*—Bernard Pianalto

*Attorney, Agent, or Firm*—Young & Thompson

[57] ABSTRACT

A process and apparatus for the preparation and coating of the surface of a substrate by thermal projection, in which the surface of the substrate is progressively subjected to laser irradiation thereby at least partially to eliminate a superficial contaminating film on the surface of the substrate, and then there is projected by a thermal projection device a deposit material on the surface thus prepared immediately after the preparation. The surface of the substrate is subjected to successive laser and thermal projection treatments thereby to lay down on the surface a plurality of layers of deposit material. The substrate can be cylindrical, and can be rotated about its axis while continuously applying laser radiation and thermal projection thereto, with the substrate rotating in a direction such that the surface of the substrate is subjected first to laser radiation and subsequently to thermal projection. The laser is a pulsed laser.

12 Claims, 2 Drawing Sheets

PROCESS FOR THE PREPARATION AND COATING OF A SURFACE

This a continuation-in-part application of Ser. No. 08/093,715 filed on Jul. 20, 1993 now abandoned.

FIELD OF THE INVENTION

The present invention relates to the field of surface treatment, more particularly by surface deposits, and has for its object a process for the preparation and coating of a surface as well as an apparatus for practicing said process.

BACKGROUND OF THE INVENTION

During a treatment of covering a substrate by means of a deposit, the superficial properties of the substrate and the quality of the interface between the surface of said substrate and the deposit material play an essential role in the mechanical strength and adherence of said deposit.

This is particularly apparent in the case of an application of the deposit by means of thermal projection, for example by a projected plasma arc or by a torch.

At present, there exist principally two types of preparation of a surface for a deposit, namely the ranges of surface preparation and the processes for improvement of the geometric appearance of the surface, the two types of preparations being used in the framework of coating by thermal projection.

The usual ranges of surface preparation comprise generally, on the one hand, a first coarse degreasing, on the other hand, a mechanical preparation of the surface by means of tools or supported abrasive materials (polishers), in suspension (tumbling, vibrating) or projected (sandblasting, shot blasting) and finally a second complementary degreasing.

Nevertheless, these different operations each require a particular corresponding installation, with possible adaptation of each installation to the condition of the substrate to be degreased and to the requisite surface properties.

Moreover, the mechanical operations of preparation of the surface give rise in certain materials to an embedding of particles at the surface, which is harmful to the final properties of the deposit on the substrate, as well as deformation of these latter if they are thin.

Moreover, certain materials, such as titanium, aluminum or their alloys, have a very high affinity for oxygen and reoxidize very rapidly after a mechanical surface preparation. Thus, the time necessary for the installation of the prepared substrate, without taking account of the time necessary for the removal of said substrate from the mechanical preparation installation and its transport toward the thermal projection installation, is itself already sufficient to give rise, in ambient atmosphere, to the formation of a layer of oxide, although of low thickness, but nevertheless detrimental to the mechanical strength and adherence of the subsequently applied deposit.

SUMMARY OF THE INVENTION

The present invention has particularly for its object to overcome the recited drawbacks and, beyond that, can permit the pursuit of this approach in the course of the coating process.

To this end, it has for its object a process for the preparation and coating of the surface of substrates, said coating being effected by thermal projection in normal or controlled atmosphere, characterized in that it consists essentially in progressively subjecting the surface of a substrate to be treated to laser irradiation, giving rise to a total or partial elimination of the superficial contaminant film and a modification of the morphology of the subjacent surface of the substrate, and in projecting, by means of a thermal projection device, the deposit material on the surface region thus prepared, immediately after said preparation and in synchronism with this latter, whereby in the case of continuous operation of the laser during the projection of the deposit, the successive preparation of the surface of each layer constituting the deposit permits improvement of the properties of the deposit.

The invention also has for its object an apparatus for the preparation and coating of a surface by the practice of the recited invention, characterized in that it is principally constituted, on the one hand, by a thermal projection device, for example a plasma torch, on the other hand by an apparatus for the generation of a pulsed laser beam, and finally, by apparatus for the controlled support and movement of the substrate to be treated, the impact zone of the laser beam on the substrate being either overlapping the impact zone of the projected stream of material to be deposited, or disposed adjacent to this latter in a direction opposite the direction of movement of the substrate.

BRIEF DESCRIPTION OF THE DRAWINGS

The invention will be better understood from the following description, which relates to a preferred embodiment, given by way of non-limiting example, and explained with reference to the attached schematic drawings, in which.

DETAILED DESCRIPTION OF THE INVENTION

Figure 1:
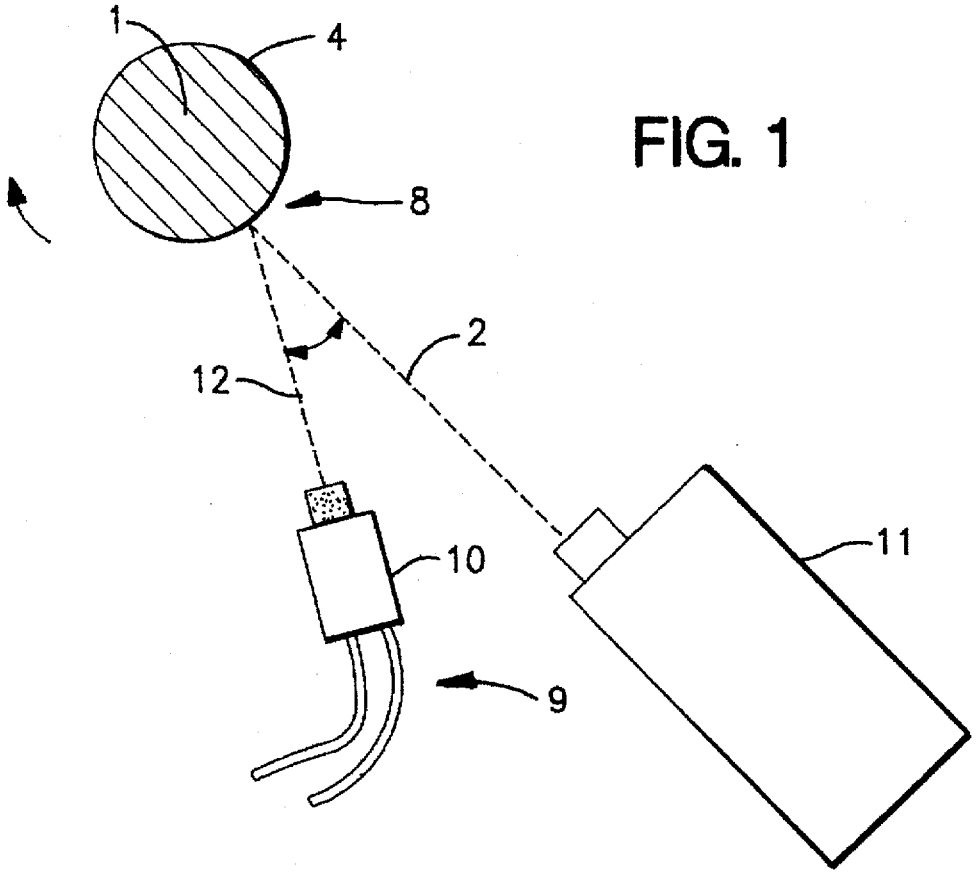
FIG. 1 is a schematic view of a device for surface preparation and surface coating according to the invention.

According to the invention, the process for preparation and coating of a surface consists essentially in progressively subjecting the surface of a substrate to be treated to laser irradiation 2, giving rise to a total or partial elimination of the superficial contaminating film 3 and a modification of the morphology of the subjacent surface 4 of the substrate 1, and projecting, by means of a thermal projection device 9, the deposit material 5 on the prepared surface region 6, immediately after said preparation operation and in synchronism with this latter.

The action of the laser beam 2 falling on the surface of substrate 1 covered with a film 3 of contaminating material results in three distinct phenomena, namely, on the one hand, a simple thermal effect, on the other hand, a vaporization of at least a portion of the contaminating film 3 creating a plasma of vaporized material having high speed of ejection, and, finally, a shockwave induced by the natural expansion of the plasma.

Figure 2:
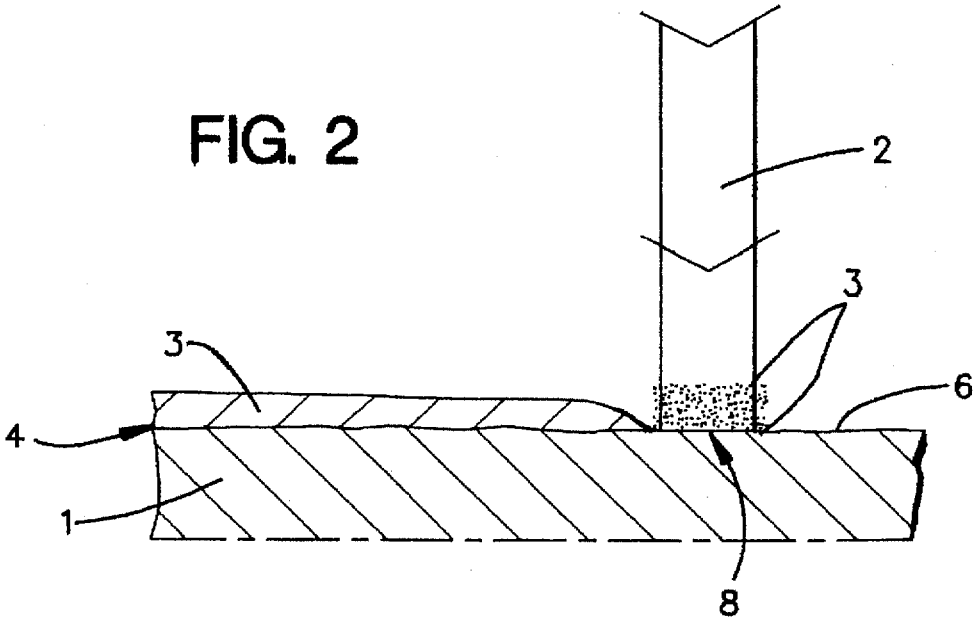
FIG. 2 is a cross-sectional view of a substrate subjected to the process of preparation according to the invention.

Moreover, the plasma of material vapors induces a compressive shockwave, from the surface of the portion of the remaining contaminating film 3 toward the interior of the substrate 1, said compression wave being reflected at the interface of the contaminating film 3 and the surface 4 of the substrate 1 and thus giving rise to a loosening, a fracturing and an expulsion of the remaining part of said contaminating film 3 (FIG. 2).

As a result, a surface of the substrate is rendered perfectly adapted to receive the deposit in one treatment operation.

Moreover, the laying down of the deposit material 5 is effected immediately after preparation with the laser beam 2, thereby preventing any formation of a new superficial contaminating film 3, particularly by oxidation of the material of the substrate 1 at its surface (FIG. 3) or by condensation.

The preparation of the surface according to the invention is preferably effected by means of successive laser pulses, giving rise to an elimination of the contaminants in adjacent zones 8, each being adapted to be subjected to several consecutive impacts.

According to a characteristic of the invention, the values of the frequency of impact and of the surface of the laser irradiation zone 8 are adapted to the speed of displacement, preferably optimally, of the thermal projection device 9 relative to the surface 4 of the substrate 1, thereby permitting the precise synchronization of the action of the laser beam 2 with that of the device 9 and thus to cause to approach as closely as possible, for a given zone of the surface of the substrate, the instant of the preparation of the surface and that of the laying down of the deposit material 5 by thermal projection.

Moreover, the power of the laser pulses can preferably be adjusted so as to achieve, not only the elimination of the contaminating film 3, but also a fusion and/or a superficial deformation of the material of the substrate 1 at the impact zone 8 of said laser beam 2. The value of the power necessary to obtain this result depends of course on the thickness of the contaminating film 3 and on the nature of the material of the substrate 1 to be treated. As a result, there is an irregular surface 4 of the substrate after laser irradiation, particularly at the center of the impact zone 8, having an increased roughness promoting the adherence and solid anchoring of the deposit material 5 laid down by consecutive thermal projection.

Figure 3:
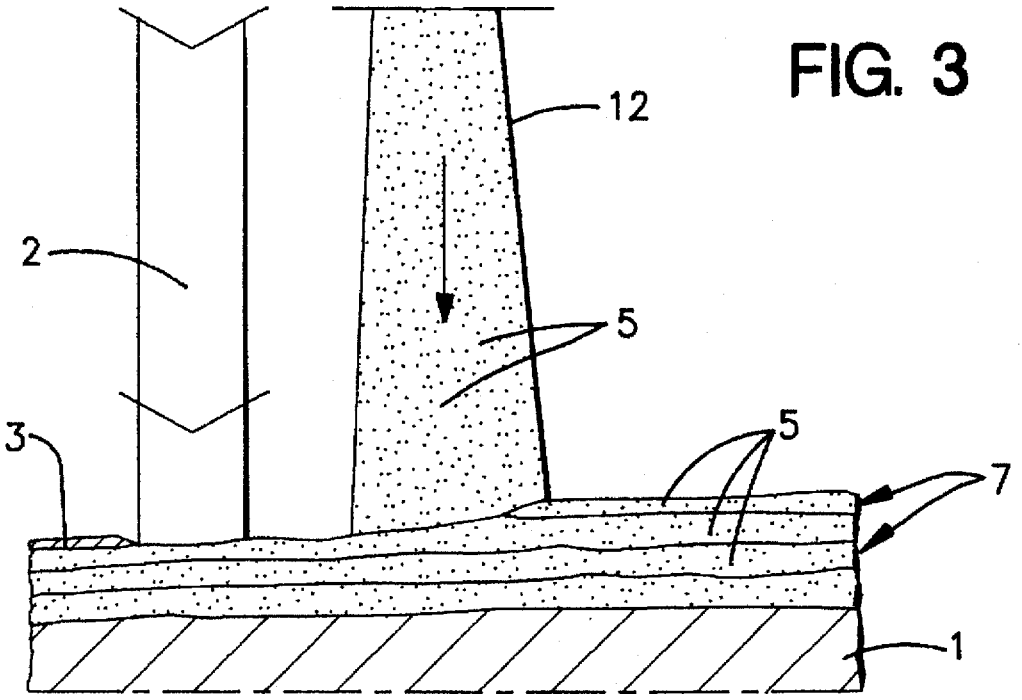
FIG. 3 is a view similar to that of FIG. 2 showing the process of surface coating according to the invention, wherein the impact zone of the laser beam is adjacent to the impact zone of the projected stream of material.
Figure 4:
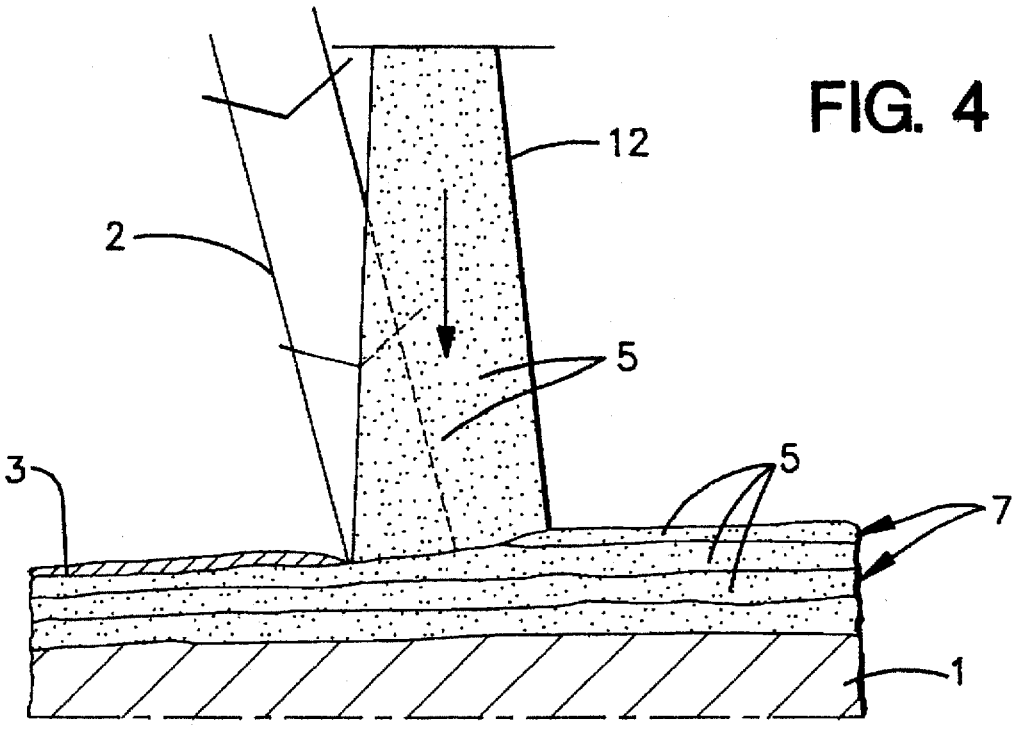
FIG. 4 is a view similar to that of FIG. 2 but showing the process of surface coating according to another embodiment of the invention, wherein the impact zone of the laser beam overlaps the impact zone of the projected stream of material.

According to the present invention, the impact zones of the laser beam and of the projected stream of coating material are disposed adjacent to one another (FIG. 3). This means that the projected stream of material is immediately deposited after the action of the laser beam. Preferably, these impact zones are overlapping (FIG. 4), which means that the projected stream of material is deposited simultaneously with the action of the laser beam.

Indeed, when the laser beam and the projected stream of material cover the same zone, the action of the laser beam precedes the projected stream of coating material by a fraction of a second, since photons travel at the speed of light, which is not the case for the particles of coating material.

Such an arrangement prevents any surface oxidation between the passage of the laser beam and the projected stream of deposited coating material, without the need of any particular protected atmosphere, even for substrate materials, which readily oxidize in a few milliseconds.

Moreover, due to the superposition, or at least partial overlapping of the impact zones, the laser beam can act on the particles of coating material during, or immediately after, their deposition on the substrate.

Consequently, the laser beam will be able to extract portions of particles not strongly fixed to the substrate and/or remove the oxidation film which could have formed on such particles during their projection. As a result, there is an increase of the adhesion properties of the coating, and an appreciable reduction in porosity of the deposited material.

Moreover, the spatial proximity of the laser beam and the projected stream of coating material entails that the thermal projection apparatus and the apparatus for generating the laser beam be arranged on the same work station, or on a same robotic arm.

According to another characteristic of the invention, the process for preparation and coating of the surface consists, during application of several superposed layers 7 of deposit material 5 by successive depositions (FIGS. 3 and 4), in providing for a given zone immediately before deposit of each new layer 7, a preparation and a modification by laser beam 2 of the leveled deposited layer 7.

According to the invention, the goal sought by the laser beam is not only to scour the substrate surface, but to obtain a surface which is irregular and rough in order to achieve a solid anchoring of the coating, and to deposit thick coating layers in several successive passes. Indeed, after each pass, the plasma torch deposits a discontinuous sublayer of coating material after cleaning and compacting the preceding sublayer by the laser beam.

Thus, for a given zone of the substrate 1, there is eliminated, by the continuous action of the pulsed laser beam 2, the contaminants 3, condensates and particles of low adherence that may be present on the latter layer 7 of deposit material 5 laid down during the preceding passage of the device 9 and, simultaneously, there is effected a compaction of the preceding layers 7, resulting in a substantial decrease of porosity, as well as a reinforcement of the mechanical strength of the assembly of the whole of the applied coating.

The invention also has for its object an apparatus for surface preparation and coating for practicing the process, consisting, on the one hand, of a thermal projection apparatus 9, on the other hand, of an apparatus 11 for the generation of a pulsed laser beam 2, and, finally, an apparatus for supporting and controllably displacing the substrate 1 to be treated, the impact zone 8 of the laser beam 2 on the substrate 1 being either overlapping the impact zone of the projection stream 12 of the apparatus 9, or disposed adjacent this latter in a direction opposite the direction of movement of the substrate 1.

According to a particular embodiment of the invention, and as shown in FIG. 1 of the accompanying drawing, the apparatus for supporting and displacing effects, for the treatment of substrates 1 having an axis of symmetry, a rotation of said substrate about its axis of symmetry, the thermal projection apparatus 9 and the apparatus 11 for generation of the laser beam 2 being disposed about said substrate 1 in a manner such that the direction of propagation of the laser beam 2 and the direction of the stream 12 of projected deposit material 5 will be nearly perpendicular to the surface of the substrate 1, the angle between the two streams 2 and 12, preferably as small as possible, being adapted to the geometry and size of the piece.

By way of example of a practical construction, there is described hereafter the apparatus for its practice, the adjustment of the parameters for surface preparation and deposit as well as the results obtained by the deposition of a deposit material 5 constituted by $Al_2O_3$ 60% by weight and $TiO_2$ 40% by weight, on a substrate consisting of an aluminum alloy, e.g., AU4G.

The apparatus 11 for generation of laser pulses is in the form of a triggered YAG-Nd laser, known by the designation 502 DNS of the BMI Company, whose wavelength is 1.06 μm, pulse duration 12 ns, pulse power up to 700 mJ, and spot diameter of about 8 mm, permitting eliminating, for example, contaminant films 3 having thicknesses up to 0.25 μm (titanium oxide).

The apparatus 9 for thermal projection can consist of a conventional atmospheric plasma projection station, whose optimum speed of relative displacement of the torch 10 relative to the substrate 1 is 75 m/mm and mean projection distance is 0.13 m, the thickness of the layer 7 of deposit material 5 laid down at each pass being about 10 μm.

After the deposit of several layers 7 of deposit material 5, with the continuous action of the laser on the surfaces before thermal projection, comparative tests have shown, for the practical case recited, a substantial reduction of the porosity of the deposits (of the order of 70%) and a remarkable increase of the adherence of said deposits to the substrate 1 (of the order of 400%) relative to deposits effectuated without the action of the laser beam 2.

Of course, the invention is not limited to the embodiment described and shown in the accompanying drawing. Modifications remain possible, particularly as to the construction of the various elements or by substitution of equivalent techniques, without thereby departing from the scope of protection of the invention.

What is claimed is:

1. A process for the preparation and coating of a surface of a substrate by thermal projection, comprising:

progressively subjecting a surface of a substrate to laser irradiation thereby at least partially to eliminate a superficial contaminating film on the surface of the substrate and to cause the surface to have an increased roughness;

projecting by means of a thermal projection device a deposit material on the surface thus prepared immediately after said preparation so as to result in an overlapping of the impact zones of the laser beam and of the projected deposit material; and subjecting the surface of the substrate to successive laser and thermal projection treatments to lay down on the surface a plurality of layers of the same said deposit material, thereby to decrease substantially the porosity and to increase the adherence of previously deposited said layers of deposit material.

2. A process as claimed in claim 1, wherein the substrate is cylindrical, and rotating the substrate about its axis while continuously applying laser radiation and thermal projection thereto, with the substrate rotating in a direction such that the surface of the substrate is subjected first to said laser radiation and subsequently to said thermal projection.

3. A process as claimed in claim 2, wherein said laser radiation and said thermal deposition are effected in directions substantially perpendicular to the surface of the substrate, said directions being disposed at a small acute angle to each other.

4. A process as claimed in claim 1, wherein said deposit material is metal oxide.

5. A process as claimed in claim 4, wherein said metal oxide is aluminum oxide and titanium oxide.

6. A process as claimed in claim 1, wherein said substrate is an aluminum alloy.

7. A process for the preparation and coating of a surface of a substrate by thermal projection, comprising:

progressively subjecting a surface of a substrate to laser irradiation comprised of successive laser pulses thereby at least partially to eliminate a superficial contaminating film on the surface of the substrate and to modify the morphology of a subjacent surface of the substrate so that the subjacent surface has an increased roughness;

projecting by means of a thermal projection device a deposit material on the surface thus prepared immediately after said preparation and in synchronism therewith so as to result in an overlapping of the impact zones of the laser beam and of the projected deposit material; and obtaining a coating by application of several superposed layers of deposit material by successive depositions, said coating being obtained by providing for a given zone before deposit of each new layer, a preparation and modification by laser beam of a deposited layer, such that with the continuous action of the laser during thermal projection, the successive preparation of each layer surface results in an improvement of the properties of the deposit and a compaction of the preceding layers.

8. A process as claimed in claim 7 wherein the substrate is cylindrical, and rotating the substrate about its axis while continuously applying laser radiation and thermal projection thereto, with the substrate rotating in a direction such that the surface of the substrate is subjected first to said laser radiation and subsequently to said thermal projection.

9. A process as claimed in claim 8 wherein said laser radiation and said thermal deposition are effected in directions substantially perpendicular to the surface of the substrate, said directions being disposed at a small acute angle to each other.

10. A process as claimed in claim 9, wherein said deposit material is metal oxide.

11. A process as claimed in claim 10, wherein said metal oxide is aluminum oxide and titanium oxide.

12. A process as claimed in claim 7, wherein said substrate is an aluminum alloy.

* * * * *